United States Patent [19]

Insalaco

[11] Patent Number: 4,834,125

[45] Date of Patent: May 30, 1989

[54] REMOVABLE UTENSIL BASKET FOR A DISHWASHER

[75] Inventor: Robert W. Insalaco, Knox County, Tenn.

[73] Assignee: Whirlpool Corporation, Benton Harbor, Mich.

[21] Appl. No.: 29,084

[22] Filed: Mar. 23, 1987

[51] Int. Cl.[4] ..... B08B 3/00

[52] U.S. Cl. ..... 134/201; 211/70.7

[58] Field of Search ..... 134/200, 201; 211/41, 211/88, 70.7, 87

[56] References Cited

U.S. PATENT DOCUMENTS

| | | | |
|---|---|---|---|
| 1,487,942 | 3/1924 | Hines | 211/41 |
| 2,440,507 | 4/1948 | Geralds | 211/41 X |
| 2,937,063 | 5/1960 | Kahn | 134/200 |
| 3,182,854 | 5/1965 | Geller | 211/41 X |
| 3,383,148 | 5/1968 | Dicken, Jr. | 211/41 X |
| 3,727,622 | 4/1973 | Jacobs | 134/183 |

*Primary Examiner*—Harvey C. Hornsby
*Assistant Examiner*—K. O'Leary
*Attorney, Agent, or Firm*—Mason, Kolehmainen, Rathburn & Wyss

[57] ABSTRACT

An automatic, front loading dishwasher having a cabinet with an opening in its front side and a washing chamber interiorly disposed within the cabinet includes a removable utensil basket removably secured to an upper dish rack of the dishwasher. The removable utensil basket may be filled with silverware or other utensils or items to be cleaned by the dishwasher. The dishwasher also includes a door having an enlarged cavity formed on an inner portion thereof in communication with the washing chamber. Upon being removably attached to a front portion of the upper dish rack, the utensil basket is adapted to be disposed within the cavity formed in the dishwasher door when that door is closed, thereby more fully utilizing the washing capacity of the dishwasher.

24 Claims, 2 Drawing Sheets

REMOVABLE UTENSIL BASKET FOR A DISHWASHER

BACKGROUND OF THE INVENTION

A. Field of the Invention

The present invention generally relates to automatic dishwashers and, more particularly, to a new and improved removable utensil basket for attachment to a dish rack of an automatic dishwasher.

B. Description of the Prior Art

Baskets or containers for retaining various products or devices are old and well known in the prior art as exemplified by U.S. Pat. Nos. 618,425; 2,095,810; 2,149,821; 2,813,767; 2,907,470; 3,050,073; 3,167,183; 3,665,943; 3,680,712; 3,742,965; 3,854,762; 3,995,744; and 4,456,125. The '425 patent concerns a water-pervious combined sponge and soap holder. The '810 patent discloses a hinged shelf rack secured to the door of a refrigerator. The '821 patent discloses an egg holder removably suspended beneath a shelf of a refrigerator to increase storage capacity by utilizing available space in a refrigerator. The '767 patent discloses racks secured to the door of a refrigerator for holding food packages in stacks on the door of the refrigerator. The '470 patent discloses a water-pervious dish rack with movable sub-racks for use in a dishwasher. The '073 patent discloses a water-pervious removable basket having a pair of manually engageable handles for use in a dishwasher and having a separate silverware receptacle provided within the basket. The '183 patent discloses water-pervious movable dish racks or baskets for use in a dishwasher.

The '943 patent discloses a water-pervious silverware basket that is releasably fastened in position on the door of a dishwasher to permit silverware to be cleaned in the dishwasher. The basket is removable from the dishwasher at the conclusion of the washing operation. The '712 patent discloses a modular display rack or stand constructed of interconnected wire rods and including a plurality of disconnectable and removable rack sections for permitting the size and capacity of the rack assembly to be selectively varied. The '965 patent discloses a dish rinser for use in a sink having a smaller cutlery or silverware unit removably disposed in the dish rinser. The '762 patent, in addition to providing a general description of a conventional automatic dishwasher, discloses a plurality of silverware baskets 20 and 21 mounted on the door of the dishwasher. The '744 patent discloses a collapsible merchandise display system that has upper parallel spaced rails for receiving mounting hook portions of wire-formed, removable display baskets. Finally, the '125 patent discloses a basket arrangement in which a plurality of wire baskets may be vertically suspended, one from another, to provide a vertically stacked, hanging basket assembly.

Although many baskets or container arrangements are disclosed in the prior art, none to applicant's knowledge addresses the problem that exists in the dishwasher field wherein, for cost purposes, different models of automatic dishwashers may utilize essentially the same inner door construction. For example, one model of a dishwasher as depicted in the '762 patent utilizes silverware baskets disposed in a cavity formed in the inner door of the dishwasher for receiving silverware and other utensils to be cleaned by the dishwasher. A different dishwasher model may omit the silverware baskets mounted in the inner cavity of the door while using essentially the same outer and inner door construction. In such a case, the full capacity of the dishwasher is not utilized, resulting in less efficient dishwashing operations. Therefore, a need exists in the dishwasher industry to maximize the washing capacity and, thus, the efficiency of a dishwasher while maintaining cost and manufacturing efficiencies resulting from the use of common or similar parts in different dishwasher models.

SUMMARY OF THE INVENTION

An object of the present invention is to provide a new and improved removable utensil basket for attachment to a dish rack of an automatic dishwasher.

Another object of the present invention is to provide a new and improved removable utensil basket for attachment to the upper dish rack of a dishwasher, thereby utilizing the space presented by a cavity formed in the inner door of the dishwasher.

Briefly, the present invention constitutes a new and improved removable utensil basket for attachment to a dish rack of a dishwasher. The utensil basket includes a pair of side walls, a water-pervious front wall, a water-pervious back wall and a water-pervious bottom wall. The front, back and bottom walls preferably are formed by a plurality of transversely disposed, interconnected ribs; and the entire utensil basket preferably is molded as an integral unit from a rigid, but flexible, plastic, such as polypropylene. The utensil basket further includes a handle and a pair of mounting hooks. The mounting hooks enable the utensil basket to be firmly retained in engagement with the front of an upper dish rack of the dishwasher so that silverware or other utensils disposed in the utensil basket can be cleaned during a washing operation of the dishwasher. After cleaning, the integrally formed handle may be grasped by an operator of the dishwasher and the utensil basket may be removed from the dishwasher. The removable utensil basket thereby increases the washing capacity of a dishwasher and, thus, the overall washing efficiency of the dishwasher while retaining cost effectiveness with respect to the construction of inner doors for different dishwasher models.

BRIEF DESCRIPTION OF THE DRAWING

The above and other objects, advantages and novel features of the present invention will become apparent from the following detailed description of the preferred embodiment of the present invention illustrated in the accompanying drawing wherein.

DESCRIPTION OF THE PREFERRED EMBODIMENT

Figure 5:
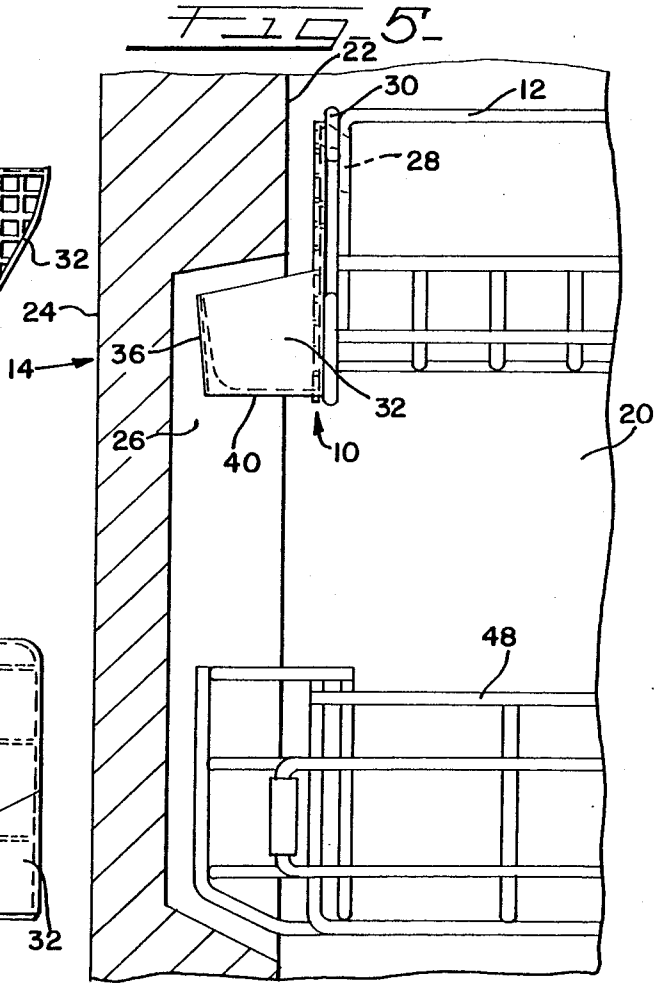
FIG. 5 is an enlarged, fragmentary, cross-sectional view of the dishwasher of FIG. 1 illustrating the manner in which the washing capacity of the dishwasher of FIG. 1 may be more fully utilized.
Figure 4:
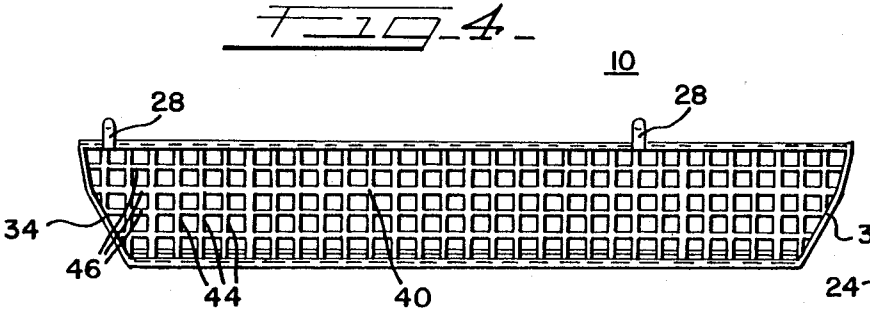
FIG. 4 is an end elevational view of the utensil basket of FIG. 1.
Figure 3:
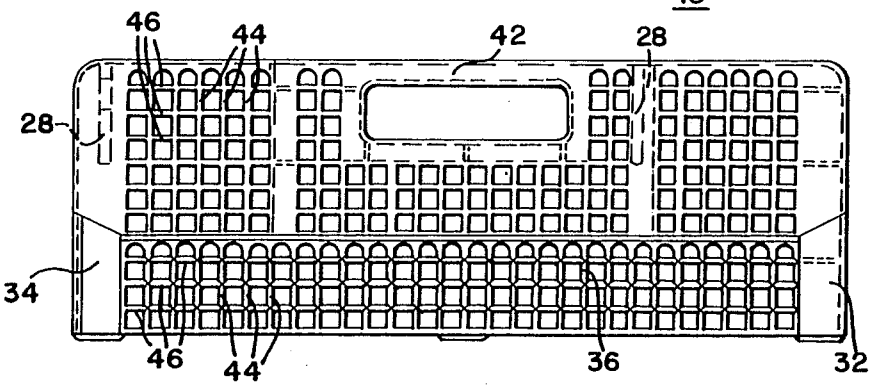
FIG. 3 is a front elevational view of the utensil basket of FIG. 1.

Referring to the drawing and specifically to FIGS. 1–5 thereof, there is illustrated a new and improved removable utensil basket 10 for attachment to an upper dish rack 12 in an automatic, front loading dishwasher 14. The dishwasher 14 is conventional, per se, and includes a cabinet 16 provided with an opening 18 at its front side to permit entry into a washing chamber or enclosure 20. The opening 18 has a conventional seal or gasket (not illustrated) disposed thereabout for mating with and forming a seal to an inner door 22 of the dishwasher door 24. The door 24 is pivotably connected to the cabinet 16 at the bottom of the opening 18 and is movable from an open position (FIG. 1) to an intermediate position (FIG. 2) and, subsequently, to a closed position (FIG. 5). When in a closed position, the inner door 22 tightly engages the seal or gasket disposed about the opening 18 to prevent leakage of water from the washing chamber 20. While forming no part of this invention, the dishwasher 14 may include all the customary or conventional components associated with an automatic dishwasher as described in detail in, for example, the above-identified '762 patent. The above-identified '762 patent is incorporated herein by reference; and reference may be had thereto for a detailed description of conventional components of an automatic dishwasher.

The inner door 22 of the dishwasher door 24 is formed with an enlarged cavity 26 that in dishwasher models other than that depicted in the drawing may have one or more silverware or utensil baskets disposed therein and mounted to the door 24. See, for example, the dishwasher depicted in the above-identified '762 patent which utilizes such a construction. In order to save manufacturing costs, dishwasher manufacturers may prefer to utilize as many common components with different dishwasher models as possible. Thus, a particular dishwasher manufacturer may utilize substantially the same dishwasher door construction including the cavity 26 formed in the inner door 22 regardless of whether or not one or more silverware or utensil baskets are disposed therein and mounted to the door 24. For those dishwasher models having the cavity 26 without one or more silverware or utensil baskets disposed therein and secured to the door, the full washing capacity of the dishwasher 14 may be under-utilized and therefore the overall washing efficiency of the dishwasher 14 may not be optimized.

In accordance with an important feature of the present invention, the utensil basket 10 includes a pair of downwardly directed, spaced apart, integrally molded hooks 28 to securely, but removably, mount the basket 10 to a front portion 30 of the upper dish rack 12. Preferably, the utensil basket 10 is formed from a rigid, but flexible, plastic material, such as polypropylene. The basket 10 further includes, as integrally formed components thereof, a pair of spaced apart side walls 32 and 34, a water-pervious front wall 36, a water-pervious back wall 38, a water-pervious bottom wall 40 and a manually engageable handle 42 formed in the back wall 38. Preferably, the front wall 36, the back wall 38 and the bottom wall 40 are formed by a plurality of transversely disposed, interconnected, integrally molded strips 44 and 46. The strips 44 and 46 forming the front wall 36, the back wall 38 and the bottom wall 40 may be formed, as is conventional, with tapered configurations to facilitate entry of the washing and rinsing liquids projected by the dishwasher 14 through the openings between the interconnected strips 44 and 46 during a washing cycle. The removable utensil basket 10 may be filled with silverware or other utensils and attached to the upper dish rack 12 to enable the silverware or utensils to be cleaned during a cleaning operation of the dishwasher 14. Subsequently, the basket 10 may be removed from both the upper dish rack 12 and the dishwasher 14 to facilitate both the cooling and storage of silverware or utensils disposed therein after a cleaning operation of the dishwasher 14.

Figure 2:
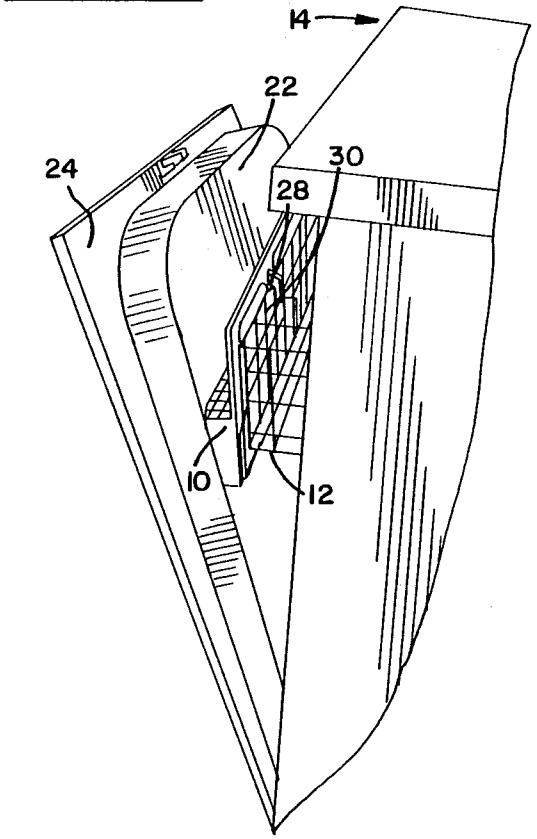
FIG. 2 is a fragmentary perspective view of the dishwasher of FIG. 1 with the door in a partially closed position.
Figure 1:
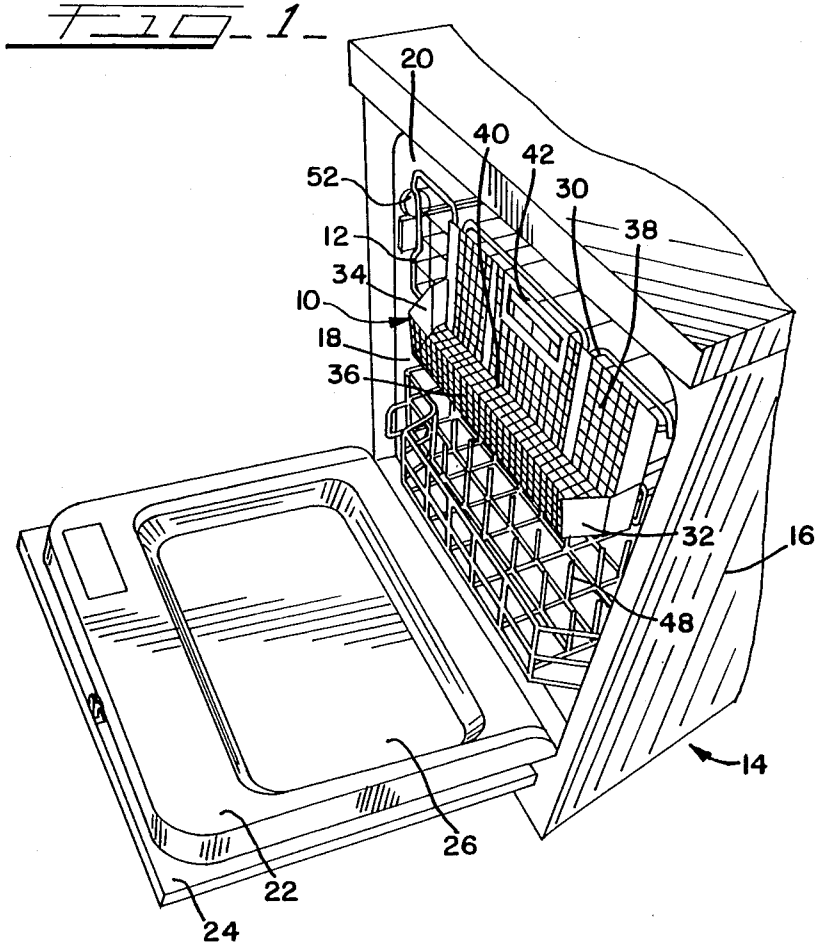
FIG. 1 illustrates an automatic, front loading dishwasher utilizing a removable utensil basket attached to a dish rack of the dishwasher, constructed in accordance with the principles of the present invention.

Preferably, a lower dish rack 48 (FIGS. 1 and 5) is formed with an outwardly projecting front portion 50 configured to extend into the cavity 26 in the inner door 22 thereby to utilize more fully the washing capacity of the dishwasher 14. Furthermore, as is conventional, the upper dish rack 12 and the lower dish rack 48 are movably mounted in the washing chamber 20 of the cabinet 16, for example, by a plurality of conventional rollers 52 (FIG. 1). In this manner, the upper dish rack 12 and the lower dish rack 48 may be moved into and out of the washing chamber 20 during the loading and unloading of dishes, utensils and other items to be cleaned by the dishwasher 14.

Obviously, many modifications and variations of the present invention are possible in light of the above teachings. For example, in the event that a conventional lower dish rack is used that does not extend into the cavity 26, a second removable utensil basket 10 may be secured to the front portion of such a lower dish rack, thereby to extend into the cavity 26 to utilize more fully the washing capacity of the dishwasher 14. Alternatively, in the event that such a lower dish rack is used, rather than being removably mounted to the upper dish rack 12, a single removable utensil basket 10 may simply be attached to the front portion of such a lower dish rack, thereby utilizing only a portion of the space available in the cavity 26 for disposing items to be washed by the dishwasher 14. Thus, it is to be understood that, within the scope of the appended claims, the invention may be practiced otherwise than as specifically described hereinabove.

What is claimed and desired to be secured by Letters Patent is:

1. An automatic front loading dishwasher comprising a cabinet having an opening formed in one side thereof, said cabinet defining an interiorly disposed washing chamber, a door movable between an open position and a closed position for closing said opening in said cabinet, a dish rack disposed within said washing chamber for retaining items to be washed by said dishwasher, said door having an enlarged cavity formed on the inner portion thereof in communication with said washing chamber, and basket means removably mounted on said dish rack for retaining items to be washed in said dishwasher, said basket means being disposed between said dish rack and said inner portion of said door when said door is in said closed position for occupying a portion of the space formed by said cavity in said door when said door is in said closed position.

2. A dishwasher as recited in claim 1 wherein said basket means comprises a utensil basket formed as an integrally molded basket having a water-pervious front wall, a water-pervious back wall and a water-pervious bottom wall.

3. A dishwasher as recited in claim 2 wherein said utensil basket further comprises manually engageable handle means for enabling said utensil basket to be firmly grasped and carried by a human hand.

4. A dishwasher comprising a cabinet including an interiorly disposed washing chamber, an upper dish rack disposed in said washing chamber, a lower dish rack disposed in said washing chamber, a dishwasher door movable between an open position and a closed position, said door having a cavity formed therein in open communication with said washing chamber and means adapted to be at least partially disposed in said cavity when said dishwasher door is in said closed position for retaining items to be washed by said dishwasher, said retaining means comprising a basket removably attached to a portion of at least one of said upper and lower dish racks and disposed between said dish rack and said door when said door is in said closed position.

5. A dishwasher as recited in claim 4 wherein said basket comprises a removable utensil basket for retaining utensils to be washed by said dishwasher, said removable utensil basket including a water-pervious front wall, a water-pervious back wall and a water-pervious bottom wall.

6. A dishwasher as recited in claim 5 wherein said utensil basket further comprises a pair of spaced apart hooks releasably engageable with a portion of said one of said upper and lower dish racks.

7. A dishwasher as recited in claim 4 wherein said basket further includes a handle integrally formed in said basket for manual engagement by a human.

8. A dishwasher as recited in claim 4 wherein said basket comprises an integrally molded utensil basket formed from polypropylene.

9. A basket adapted for use in an automatic front loading dishwasher, said dishwasher being of the type having a cabinet with an opening formed in one side thereof to define a washing chamber and a door movable between an open position and a closed position and having an enlarged cavity formed on the inner portion thereof in communication with said washing chamber and a dish rack disposed within said washing chamber for retaining items to be washed by said dishwasher, said basket comprising means adapted to be removably mounted on and disposed exteriorly of the front of said dish rack between said dish rack and said inner portion of said door when said door is in said closed position for occupying a portion of the space formed by said cavity in said door when said door is in said closed position and for retaining items to be washed by said dishwasher.

10. A basket as recited in claim 9 wherein said occupying and retaining means comprises a removable utensil basket for retaining utensils to be washed by said dishwasher, said removable utensil basket including a water-pervious front wall, a water-pervious back wall and a water-pervious bottom wall.

11. A basket as recited in claim 10 wherein said utensil basket further comprises a pair of spaced apart hooks adapted for engagement with said front of said dish rack.

12. A basket as recited in claim 10 wherein said utensil basket further includes a handle formed in said back wall for manual engagement by a human.

13. A basket as recited in claim 10 wherein said utensil basket comprises an integrally molded utensil basket formed from polypropylene.

14. An automatic front loading dishwasher comprising a cabinet having an opening formed in one side thereof, said cabinet defining an interiorly disposed washing chamber, a door movable between an open position and a closed position for closing said opening in said cabinet, said door including inner door means for preventing leakage of water from said washing chamber, a dish rack disposed within said washing chamber for retaining items to be washed by said dishwasher, said inner door means having an enlarged cavity formed therein in communication with said washing chamber, and basket means removably mounted on said dish rack for retaining items to be washed in said dishwasher, said basket means being disposed between said dish rack and said inner portion of said door when said door is in said closed position for occupying a portion of the space formed by said cavity in said inner door means when said door is in said closed position, said basket means including a front wall, a back wall and a bottom wall, at least one of said front and back walls and at least a portion of said bottom wall being disposed in said cavity when said door is in said closed position.

15. A dishwasher as recited in claim 14 wherein said basket means comprises an integrally molded utensil basket having a water-pervious front wall, a water-pervious back wall and a water-pervious bottom wall.

16. A dishwasher as recited in claim 15 wherein said utensil basket further comprises manually engageable handle means for enabling said utensil basket to be firmly grasped and carried by a human hand.

17. A dishwasher comprising a cabinet including an interiorly disposed washing chamber, an upper dish rack disposed in said washing chamber, a lower dish rack disposed in said washing chamber, a dishwasher door movable between an open position and a closed position, said door having inner door means for preventing leakage of water from said washing chamber, said inner door means including a cavity formed therein in open communication with said washing chamber and means adapted to be at least partially disposed in said cavity when said dishwasher door is in said closed position for retaining items to be washed by said dishwasher, said retaining means comprising a basket removably attached to a portion of at least one of said upper and lower dish racks, said basket being disposed between said at least one of said upper and lower dish racks and said cavity when said dishwasher door is in said closed position thereby to enable the disposition in said cavity of said items to be washed by said dishwasher.

18. A dishwasher as recited in claim 17 wherein said basket comprises a removable utensil basket having a water-pervious front walls, a water-pervious back wall